United States Patent [19]

Heltemes

[11] 4,135,183

[45] Jan. 16, 1979

[54] ANTIPILFERAGE SYSTEM UTILIZING "FIGURE-8" SHAPED FIELD PRODUCING AND DETECTOR COILS

[75] Inventor: Eugene C. Heltemes, White Bear Lake, Minn.

[73] Assignee: Minnesota Mining and Manufacturing Company, Saint Paul, Minn.

[21] Appl. No.: 799,976

[22] Filed: May 24, 1977

[51] Int. Cl.[2] ..... G08B 13/24

[52] U.S. Cl. ..... 340/572; 179/82

[58] Field of Search ..... 340/280, 258 R, 258 C, 340/572, 553; 179/82

[56] References Cited

U.S. PATENT DOCUMENTS

| | | | |
|---|---|---|---|
| 3,758,849 | 9/1973 | Susman et al. | 340/258 C |
| 3,765,007 | 10/1973 | Elder | 340/258 R |
| 3,838,409 | 9/1974 | Minasy et al. | 340/258 C |
| 3,938,125 | 2/1976 | Benassi | 340/280 |

FOREIGN PATENT DOCUMENTS 763681 5/1934 France.

*Primary Examiner*—Glen R. Swann, III

*Attorney, Agent, or Firm*—Cruzan Alexander; Donald M. Sell; William B. Barte

[57] ABSTRACT

An improved apparatus for producing a magnetic field within an interrogation zone for detecting perturbations in the field produced by the presence of a ferromagnetic marker element includes at least a pair of field producing coils, each of which is substantially planar and is positioned on opposite sides of the interrogation zone such that the planes of the coils are parallel to each other and to a corridor defined therebetween. Each of the coils are of substantially the same overall dimension and have either a "figure-8" or "hour-glass" shape, each half of which is symmetric about a horizontal axis passing through a crossing or necked-in portion and consist of a substantially triangular shape.

19 Claims, 17 Drawing Figures

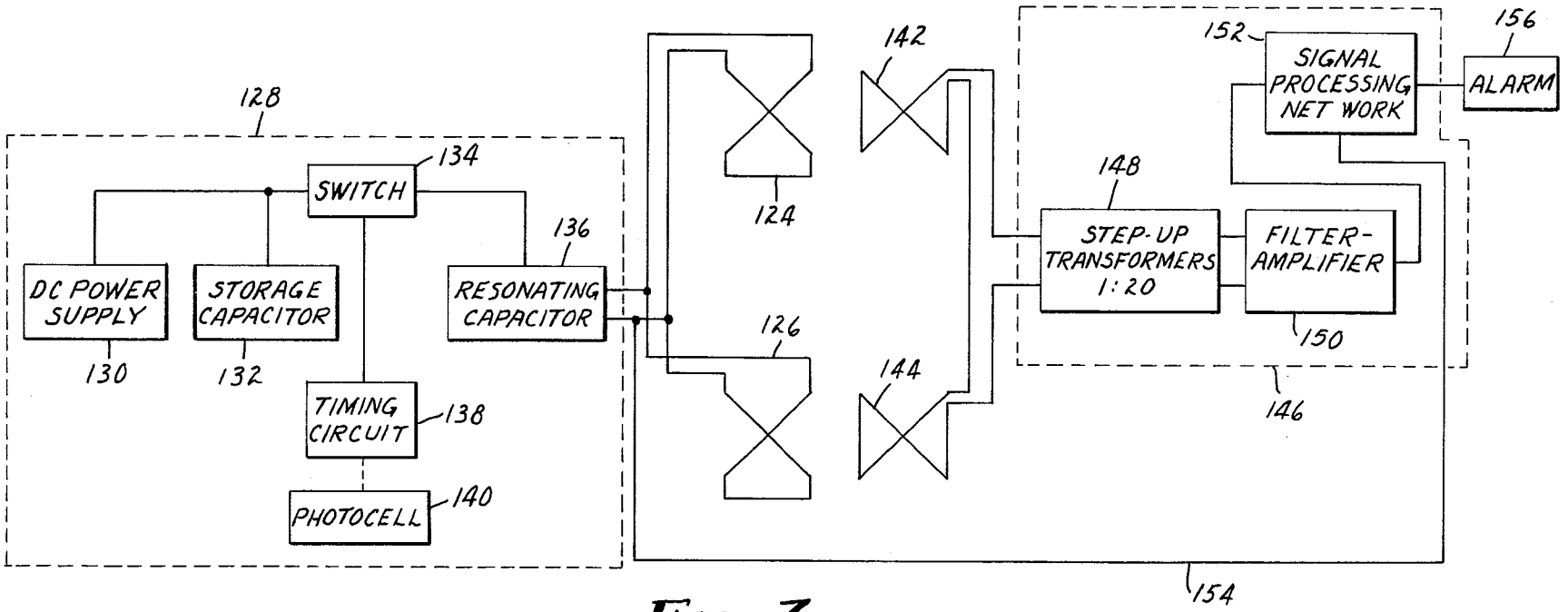
FIG. 7
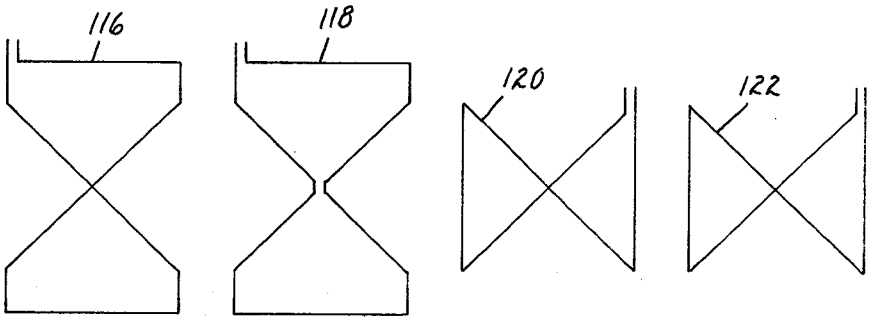
FIG. 6B
FIG. 6A
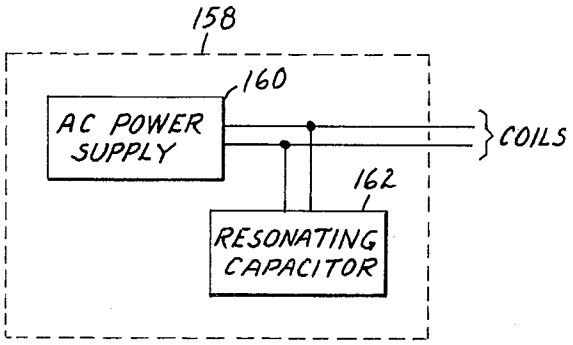
FIG. 8

ANTIPILFERAGE SYSTEM UTILIZING "FIGURE-8" SHAPED FIELD PRODUCING AND DETECTOR COILS

BACKGROUND OF THE INVENTION

1. Field of the Invention

The invention relates to systems for detecting the unauthorized removal of objects from a protected area, and in particular, to such systems in which an alternating magnetic field is produced in an interrogation zone, thereby enabling the detection of a ferromagnetic marker.

2. Description of the Prior Art

Antipilferage systems based on the detection of a ferromagnetic marker are well known, having been disclosed at least as early as 1934 in French Pat. No. 763,681 (Picard). Since typical such markers are generally responsive only along an extended dimension, the prior art has recognized that reliable detection will only be achieved with either a multidimensional marker, such as one having long and thin members which are crossed or folded, thereby providing a detectable response to a generally unidimensional interrogating field, or that a multidimensional field or fields must be provided. For example, in U.S. Pat. No. 3,697,996 (Elder and Wright) there is disclosed an apparatus for sequentially producing a plurality of fields, each of which is preferably orthogonal with respect to the other fields at every point in the interrogation zone.

In contrast to such relatively complex systems for ensuring the detection of a unidimensional marker, other systems are known in which a rotating field is provided in the zone such that there is at various times during which a marker is in the zone a field corresponding to all possible orientations of the marker so as to ensure detection thereof at some instant of time during its passage regardless of orientation. See, for example, French Pat. No. 763,681 (Picard) or U.S. Pat. No. 3,990,065 (Purinton et al.). In yet other systems, only a single field is provided in the zone, and the divergence of magnetic fields results in the lines of flux being variously oriented at different regions along a corridor through the interrogation zone. In such a system, the divergence results in different field directions along the corridor so as to improve the detection of the marker at some point along the corridor, regardless of its orientation. See, for example, U.S. Pat. No. 3,820,104 (E. R. Fearon).

SUMMARY OF THE INVENTION

The system of the present invention overcomes deficiencies in systems utilizing a single field, while at the same time avoids the complex, and hence expensive apparatus used in systems wherein sequential or rotating fields are employed. In the present system for detecting the passage of objects through an interrogation zone, there is provided a particular configuration of means for producing an alternating magnetic field in an interrogation zone together with a magnetic field detector positioned adjacent the zone such that perturbations in the field as may be caused by the presence of a ferromagnetic marker element secured to the objects may be detected. The magnetic field producing means comprises at least a pair of coils, each of which is substantially planar and is positioned on an opposite side of the interrogation zone such that the planes of the coils are parallel to each other and to a corridor defined therebetween. Each of the coils are of substantially the same overall dimensions and have a shape similar to one of a "figure-8" or an "hour-glass", wherein each half of each coil consists of a substantially triangular section which is symmetric to the other half about a horizontal axis passing through the plane of the coil at the crossing or "necked-in" portion thereof. The direction of the magnetic field components in the corridor through the interrogation zone produced between the two coils when connected to an alternating current is thus caused to vary significantly in different regions to increase the number of lines of force which will be parallel with a substantially unidimensionally responsive ferromagnetic marker element, to thereby enhance its detectability regardless of its orientation in the zone.

In one embodiment, the two field producing coils are both "figure-8" coils and are interconnected such that field components associated with both halves of both coils result in a field extending generally vertical to the corridor in one region thereof and extending generally parallel to the corridor and having an appreciable horizontal component in another region thereof.

The desirability of the field components thus provided is particularly evident when one considers the manner in which objects having a ferromagnetic marker element secured thereto are most often carried. In typical commercially accepted systems used to prevent pilferage of objects such as books in libraries, the marker elements comprise long and thin strips of a low coercive force, high permeability ferromagnetic material which are concealed in the heels or adjacent the binding of the books. Generally, female patrons carry books in their arms, such that the books are held above the waist level, and in or near the center of the corridor such that the bindings of the books are substantially vertical. In such a case, the marker elements are also nearly vertical. In contrast, male patrons generally carry books at their side such that the books are held below waist level, and off to one side of the corridor, with the bindings primarily horizontal and parallel to the corridor. The marker elements are then also primarily horizontal and parallel to the corridor. It is now recognized that a sufficiently reliable and inexpensive system, thereby ensuring its acceptance in small or low-budget institutions, results by providing field producing apparatus which establishes significant vertical field components above waist level and centered about the corridor and significant horizontal field components parallel to and off to both sides of the corridor below waist level. Accordingly, in the present invention, the field components resulting from the field producing coils ensure the reliable detection of marker elements in such probable orientations.

Alternatively, the two field producing coils may both be "hour-glass" shaped coils or one may be "figure-8" shaped and the other "hour-glass" shaped. In such embodiments, the desired field directions in different portions of the corridor are still obtained. In the latter case, even more complex field patterns result which are different on opposite sides of the corridor, thus making it more difficult to circumvent detection of a marker element.

In a further preferred embodiment, the present invention also comprises at least a pair of substantially planar "figure-8" or "hour-glass" shaped detector coils of substantially the same overall dimensions as the field producing coil, each of which detector coils is positioned proximate and parallel to one of the field producing coils such that the crossing or "necked-in" portions of each detector and field producing coil are generally aligned. Under certain conditions, substantially no mutual induction exists between the field producing and detector coils and pickup of unperturbed fields is thereby minimized. Furthermore, pickup of signals resulting from distant noise sources is also minimized with a proper configuration of detector coils.

In a particularly preferred embodiment, each half of the field producing coils consists of substantially straight horizontal legs, short vertical legs and diagonal legs forming the triangular sections which intersect at the crossing or "necked-in" portion of each coil. The detector coils are similarly constructed, absent the short vertical legs, but are positioned such that each half thereof extends at 90° with respect to the halves of the proximate field producing coils. In such a preferred embodiment, the detector coils have substantially straight vertical legs between which extend diagonal legs to form the respective intersecting triangular sections.

BRIEF DESCRIPTION OF THE DRAWING

FIGS. 6A and 6B are side views of another embodiment of field producing coils and compatible detector coils;

FIG. 7 is a block diagram of a circuit for energizing the field producing coils and for processing the signals provided by the detector coils; and FIG. 8 is a block diagram of an alternative embodiment for energizing the field producing coils.

DESCRIPTION OF THE PREFERRED EMBODIMENTS

Figure 1:
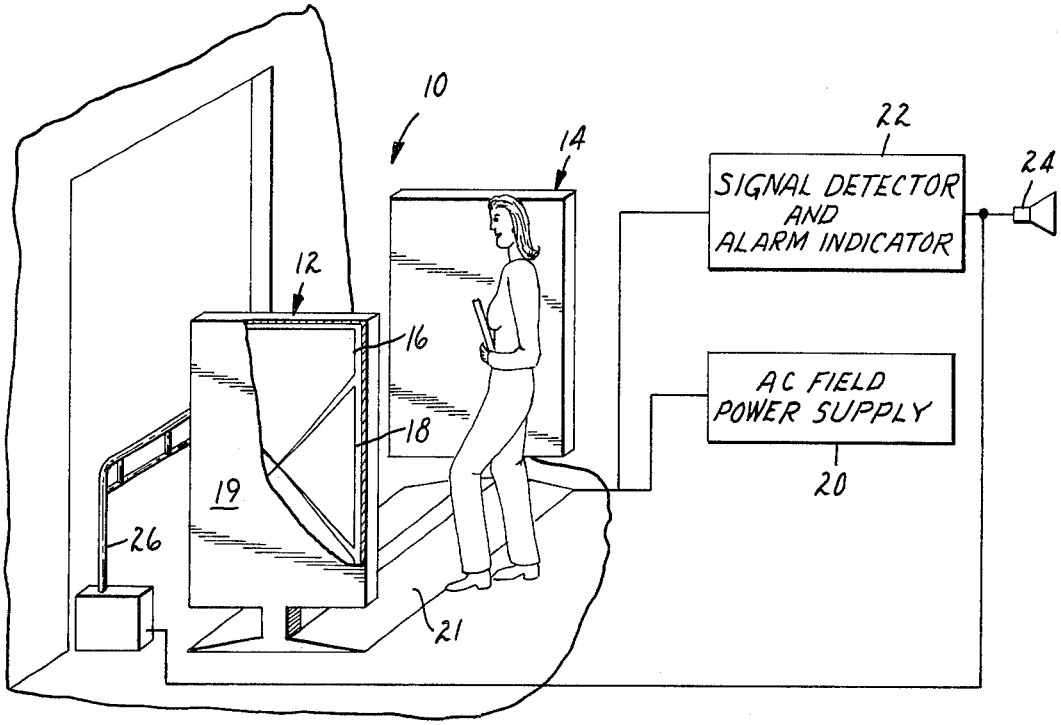
FIG. 1 is a combined perspective and block diagram view of one embodiment of the present invention.

FIG. 1 is a combined perspective and block diagram of an antipilferage system 10 such as may be conveniently used at the exit of an area in which objects to be protected are kept. In this figure, pedestals 12 and 14 are shown positioned to define a corridor therebetween which is within an interrogation zone. Positioned within each of the pedestals 12 and 14 are field producing coils 16 and detector coils 18, which coils are only shown in the cut-away portion of the pedestal 12. As is there shown and as is set forth in more detail hereinafter, the field producing coils 16 comprise vertically positioned "figure-8" coils, both of which are substantially the same overall dimensions and each of which are positioned on opposite sides of and parallel to a corridor within the interrogation zone. The detector coils 18 are similarly of equal overall dimensions and are positioned on opposite sides of the corridor adjacent and parallel to a corresponding field producing coil. The detector coils 18 may preferably be both "figure-8" coils positioned horizontally so as to fit within the constricted portion of the vertical "figure-8" field producing coils 16. In a preferred embodiment, the field producing coils 16 are energized by a field power supply 20. The field detector coils 18 are coupled in series to a signal detector and alarm indicator network 22, which network is then coupled to provide an alarm on device 24 and/or to lock an electrically controllable turnstile or gate mechanism 26. The field producing coils 16 and detector coils 18 within a given pedestal are desirably slightly offset from each other such as being secured to opposite sides of a nonmetallic support member (not shown), which members may conveniently be formed of construction graded two-by-four lumber. Accordingly, the field producing coil 16 and detector coil 18 are secured to opposite sides of such a support member so as to parallel to each other but spaced apart by a distance of approximately three to four inches (7.6 to 10.2 cm). The combined coils and support member are then conveniently covered with a decorative outer panel member such as grill cloth 19 or the like are provided with support members 21 within which wiring between the two pedestals may be concealed.

Figure 2:
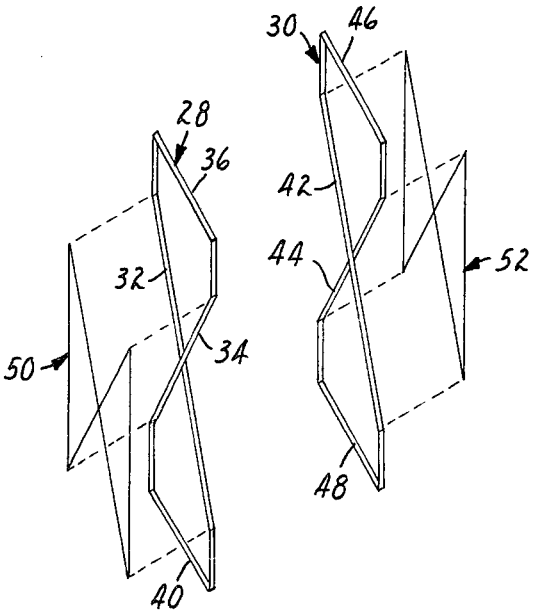
FIG. 2 is a perspective schematic view of one embodiment of the field producing coils and detector coils of the present invention.

As shown in more detail in FIG. 2, the field producing coils 28 and 30 are preferably formed of 10 turns of No. 10 AWG insulated copper wire. As is there shown, both of the coils have substantially triangular upper and lower sections extending horizontally approximately 3 feet (90 cm) and approximately 4.5 feet (140 cm) along a vertical axis. The field producing coils 28 and 30 are generally characterized as having a "figure-8" shape, i.e., that the diagonal legs 32 and 34 of coil 28 and diagonal legs 42 and 44 of coil 30 cross each other at midpoint in each respective coil so as to connect to the upper and lower horizontal legs 36 and 40 respectively through short vertical legs. The second field producing coil 30 is spaced from the first coil 28 approximately three feet (90 cm) to define the pathway or corridor therebetween. The coils 28 and 30 are preferably constructed such that the diagonal portions 32 and 34 and 42 and 44 cross at approximately 90°. The short vertical legs ensure that the overall vertical dimensions of the coils are sufficiently high to adequately cover more probable locations at which a marker would be carried through the zone, while not also requiring an unnecessarily long zone.

As is shown in FIG. 2, the field detector coils 50 and 52 each comprise one turn of No. 18 AWG gauge wire, and are also of a "figure-8" shape. The detector coils differ from the field producing coils in that the axes of the "figure-8" detector coils 50 and 52 are horizontal. The coils are thus nestled into the open areas formed by the diagonal legs 32 and 34, and 42 and 44 of the field producing coils 28 and 30, respectively. As so constructed, the detector coils 50 and 52 have vertical members approximately three feet (90 cm) long and are joined by diagonal members which meet at approximately 90°. The substantially triangular sections of both the field producing and detector coils may also be shaped to form other than right triangular sections, such as intersecting at 60° or some other angle.

By thus providing the axes of the detector coils 50 and 52 at right angles with respect to the axes of the field producing coils 28 and 30, the mutual inductance between the detector and field producing coils is substantially zero, and pickup of fundamental frequency components produced in the field producing coils into the detector coils is thereby minimized. Furthermore, a "figure-8" detector coil has been found to be best in minimizing pickup from noise sources. In addition, a horizontally positioned "figure-8" detector coil has added advantage in that the two halves of such a coil tend to cancel out pickup from electrical power lines within the floor.

Figure 3:
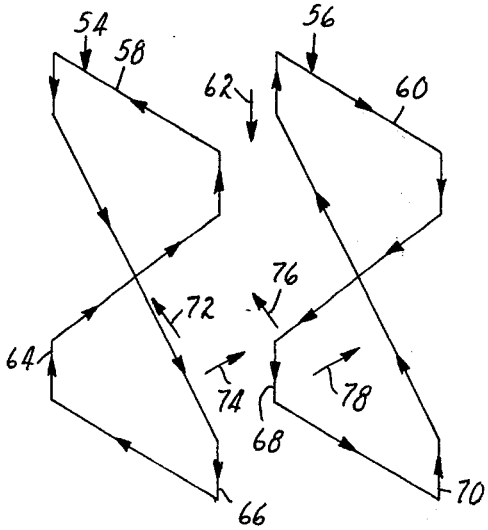
FIG. 3 is a perspective schematic view of one embodiment of the field producing coils of the present invention showing a portion of the lines of flux produced thereby.
Figure 4A:
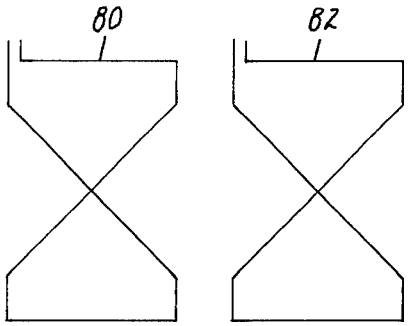
FIGS. 4A through 4E are side views of alternative combinations of field producing coils and detector coils compatible with the there depicted field producing coils.
Figure 4B:
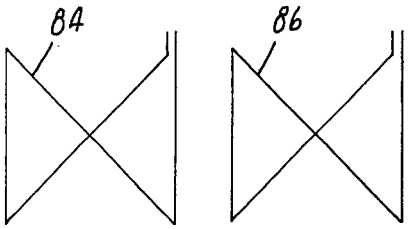

Some of the field components provided by the "figure-8" shaped field producing coils are shown in FIG. 3. In this figure, one "figure-8" shaped field producing coil 54 is shown positioned opposite a similarly dimensioned "figure-8" shaped field producing coil 56, which coils are shown in an idealized form as single windings. A series of arrows following the respective windings corresponds to directions of current flow through the respective windings. Current in the upper half of the coil 54 is thus shown to flow in a counter-clockwise direction while the current flowing in the lower half of that coil is shown to flow in a clockwise direction. In contrast, current flowing in the upper half of coil 56 is shown to flow in a clockwise direction, and vice versa in the lower half. The opposing currents and variously shaped portions of the coils result in a complex field distribution in various portions of the corridor between the two coils which is difficult to visualize. Nonetheless, it may be readily appreciated that the center portions of each of the horizontal legs 58 and 60 of the upper sections of the two coils may interact to provide a significant vertical component in the upper center portion of the corridor identified by the arrow 62. The desirability of such a field component may be best appreciated upon consideration of the most probable orientation with which articles such as books are carried through the corridor. For example, female patrons typically carry books in their arms and against their bodies above waist level. As so carried, the bindings or heel portions of the books are primarily in a vertical configuration. Since uniaxially responsive ferromagnetic marker elements such as those disclosed in U.S. Pat. Nos. 3,665,449, 3,747,086, and 3,790,945 are most readily detected by fields along their long direction, a vertical field such as that depicted by arrow 62 ensures the detection of such a marker element having a similar orientation while passing along the corridor. It should further be appreciated, however, that because of the complex distribution of fields produced by the other portions of each of the field producing coils, the detection of marker elements in other orientations will be optimized in other portions of the corridor.

The currents flowing through the lower halves of the field producing coils 54 and 56 may be appreciated to provide field components as denoted by the arrows 72, 74, 76, and 78, which field components have significant components horizontal and parallel to the corridor and which are strongest toward the edges of the corridor and below the center level thereof. The desirability of these field components is best appreciated upon consideration of another predominant configuration in which objects such as books may be carried. It has been found that many, particularly male patrons, frequently carry books at their sides below waist level. In such an event, the books are primarily carried with the bindings horizontal and parallel to the direction of travel. When so carried, the marker elements are generally positioned off to one side of the corridor, below waist level. Accordingly, the long direction of the marker elements is sufficiently aligned with the field components 72, 74, 76 and 78 to be preferentially detected as the marker element is just entering or just leaving the interrogation zone. While such a field orientation and probable positioning of the marker elements has been designed to result in optimum detectability in the regions discussed, the complex field distributions provided by the field producing coils throughout the zone, coupled with an overall intensity which will ensure that a marker element is "switched" if it is aligned within approximately 45° of the field, ensures the detection of a marker element at some location through the corridor for most orientations.

Various combinations of the field producing and detector coils which have been found to be particularly useful are further shown in FIGS. 4–6. In FIG. 4A, a pair of field producing coils are shown in a stylized view to consist of single turn "figure-8" coils 80 and 82. In this configuration, like that shown in FIG. 3, the respective coils would preferably be connected in parallel such that the field distributions depicted in FIG. 3 will result. FIGS. 4B, 4C, 4D and 4E depict stylized views of the detector coils which are desirably used with the field producing coils 80 and 82 shown in FIG. 4A. In FIG. 4B, the detector coils are shown to comprise a pair of "figure-8" shaped coils 84 and 86, respectively. The detector coils are shown to be positioned along a horizontal axis with the outer most of the parallel legs positioned vertically. Such coils may be connected in series or parallel.

The use of horizontally positioned "figure-8" detector coils together with vertically positioned "figure-8" field producing coils of similar overall dimensions results in the highly desirable condition wherein the mutual induction between each detector coil and both of the field producing coils is substantially zero. In such an event, signals produced directly by the field producing coils are not appreciably picked up by the detector coil. This substantially aids in the elimination of unwanted signals in the signal processing networks utilized to detect the presence of a marker element. The two "figure-8" detector coils minimize pickup of signals induced from electrical noise sources and, as discussed above, have the additional advantage of cancelling out pickup from close noise sources such as electrical wiring in the floor.

Figure 4C:
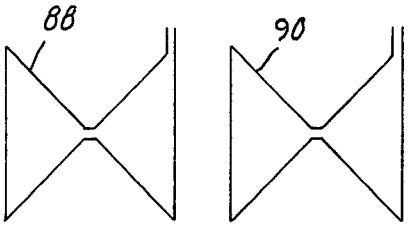
Figure 4D:
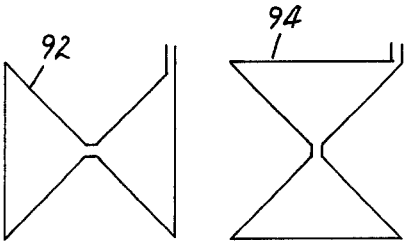
Figure 4E:
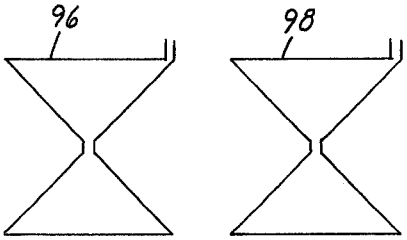
Figure 5E:
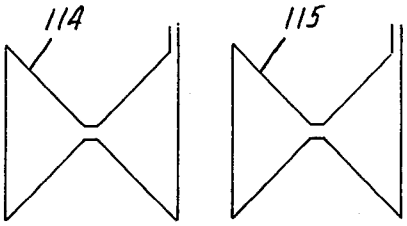

An alternative configuration depicted in FIG. 4C includes a pair of detector coils 88 and 90, in which both coils are of an "hour-glass" configuration positioned along a horizontal axis. FIG. 4D shows another embodiment in which one of the detector coils 92 is of an "hour-glass" configuration positioned horizontally while the second coil 94 is of an "hour-glass" configuration but is positioned vertically. FIG. 4E shows yet another embodiment, in which two "hour-glass" coils 96 and 98 are provided, both of which are positioned vertically. The alternate configurations depicted in FIGS. 4C–4E provide similar results, but are not as effective in cancelling pickup from proximate noise sources.

Another series of combinations of suitable field producing coils and detector coils are depicted in stylized views in FIGS. 5A–5E. In these embodiments, the field producing coils 100 and 102 are both vertically positioned "hour-glass" shaped coils and are connected in either series or parallel to provide the desired complex field distribution.

Figure 5A:
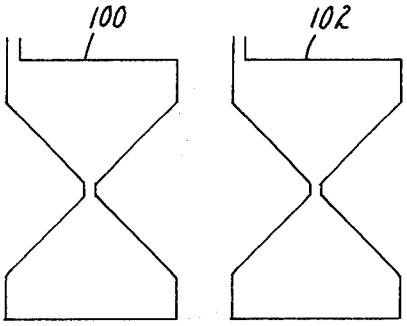
FIGS. 5A through 5E are side views of another embodiment of field producing coils and alternative combinations of detector coils compatible with the there depicted field producing coils.
Figure 5B:
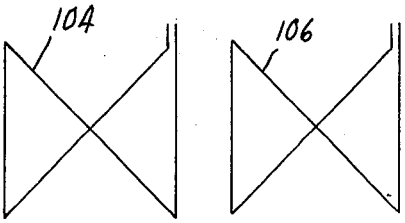
Figure 5C:
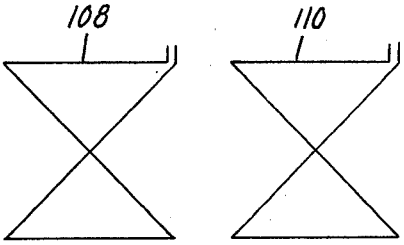
Figure 5D:
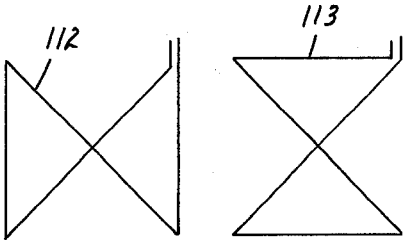

In one preferred alternative combination shown in FIG. 5B, two horizontally positioned "figure-8" detector coils 104 and 106 may be provided. In this embodiment, the detector coils 104 and 106 are positioned to nest into the "necked-in" portion of the field producing coils 100 and 102. Such a configuration is preferred over the remaining FIGS. 5C through 5E, in that each of the detector coils 104 and 106 cancels pickup from proximate noise sources such as electrical wiring in the floor, while at the same time providing substantially no mutual inductive coupling and cancellation of induced signals from distant noise sources. The alternative configurations shown in FIGS. 5C and 5D depict the use of two "figure-8" shaped coils 108 and 110 which are both positioned vertically (FIG. 5C) or which are positioned to have one positioned horizontally 112 and one vertically 113 (FIG. 5D). These alternative configurations are somewhat less desirable in that while they still provide zero mutual coupling and cancellation of pickup from distant noise sources, some pickup from proximate sources such as electrical wiring in the floor may result. The embodiment shown in FIG. 5E wherein two "hour-glass" shaped coils 114 and 115 are shown to be horizontally positioned achieves nulling of distant noise sources only where both coils are properly connected together.

Another combination of suitable field producing and detector coils is depicted in stylized view in FIGS. 6A and 6B. In this combination, as shown in FIG. 6A, one field producing coil 116 having a "figure-8" shape is combined with a second field producing coil 118 having an "hour-glass" shape. Under such an arrangement, best results are obtained with a pair of horizontally disposed "figure-8" shaped detector coils 120 and 122 as shown in FIG. 1B, such that each detector coil has substantially zero mutual inductance with respect to both field producing coils, in order to avoid pickup from the field coils and in order to cancel pickup from both distant and proximate electrical noise sources. Additional combinations of variously positioned detector coils may also be used with the field coils shown in FIG. 6A, similar to those shown in FIGS. 5C through 5E; however, the cancellation of pickup from various types of electrical noise sources may not be as effective.

A block diagram for the overall system of the present invention is set forth in FIG. 7. In this figure, the field producing coils are shown in idealized form as elements 124 and 126. These coils are energized by a field power supply shown generally as 128, within which are included a DC power supply 130, a bank of storage capacitors 132, a switch network 134, a bank of resonating capacitors 136 and a timing circuit 138. Optionally, a photocell circuit 140 may also be included. The specific components included within the power supply 128 are substantially like those disclosed in U.S. Pat. Nos. 3,665,449, 3,697,996 and 3,673,437; however, other circuits providing a similar field energization may also be used. Essentially, the field producing coils 124 and 126 are connected together with a bank of resonating capacitors 136 to form a resonant circuit. This circuit is then energized by discharging a bank of storage capacitors 132 through the resonant circuit. A solid state switching circuit 134 such as that set forth in U.S. Pat. No. 3,673,437 is preferably used to discharge the storage capacitors 132. In turn, a DC power supply 130 of a conventional design is provided to charge the storage capacitors 132 between discharge cycles. The timing circuit 138 is designed to energize the field producing coils at a repetition rate ranging between 0.1 and 1.5 seconds. Preferably, the interval is closely controlled within 1.0 and 1.2 seconds so as to preclude harmful interference with a heart beat timing control device, commonly referred to as a heart pacemaker. In response to the discharging of the storage capacitors 132 into the resonant circuit formed with the coils 124 and 126 and resonating capacitor 136, a pulse of damped oscillating magnetic fields is produced by the coils. Preferably, the characteristics of the capacitor bank 136 and coils 124 and 126 are selected to provide a frequency of oscillation of less than 10 KHz. The field producing coils 124 and 126 are desirably connected in parallel and have an inductance of approximately 400 $\mu$H each. The bank of resonating capacitors 136 are preferably selected to have a value of approximately 160 $\mu$F, such that a resonant frequency of approximately 900 hertz is provided.

For simplicity and inexpensiveness of operation, in some embodiments it is desirable that the field producing coils be continuously pulsed. In such an embodiment, the total amount of energy utilized is still sufficiently small as to avoid the need for special power circuits. Alternatively, however, a photocell network 140 may be utilized to provide an electrical signal when a patron is about to or in the process of passing through the interrogation zone. In such an embodiment, the electrical signal is then utilized to activate the timing circuit 138 and thereupon initiate the production of a train of pulsed fields.

The resonant circuit provided by the field producing coils 124 and 126 and the bank of resonating capacitors 136 are desirably selected to provide a damped oscillation which persists approximately 10 milliseconds, i.e., such that after that time the oscillations are essentially gone. It has been found that in this manner the intensity of the succession of oscillations is sufficiently strong to generally enable detection of a randomly positioned marker element for at least several successive oscillations. By ensuring the sequencing of successive pulses at approximately 1 second intervals, a marker element will generally be interrogated once during the passage through the zone, i.e., a person walking at approximately three miles per hour, i.e., 4.4 feet per second, will be interrogated once during passage through the interrogation zone which has an effective length of approximately four feet.

Perturbations in the field provided by the field producing coils in the interrogation zone are sensed by the detector coils 142 and 144. These coils are preferably connected in series and are coupled to a signal detector and alarm indicator network 146. The network 146 preferably includes a step-up transformer 148 for receiving the signals from the detector coils and for thereupon increasing the amplitude of the signals, as well as matching the impedance to optimize coupling of the signals into further signal processing circuits. A filter-amplifier network 150 further removes portions of the signal corresponding to the fundamental alternating frequency established by the field producing coils. Even though the detector coils 144 and 142 are positioned to provide substantially zero mutual inductance to minimize coupling of signals from the field producing coils 124 and 126 to the detector coils, the small field perturbations that are desirably detected require that substantially all traces of a fundamental frequency be removed. Subsequent such a removal, the signal is then processed through a signal processing network 152. This network is substantially the same as that disclosed in U.S. Pat. No. 3,665,449 and is controlled by a synchronizing pulse from the power supply 128 provided on lead 154.

Preferably the processing network 152 includes a circuit to sense for characteristic frequency components as well as the time of occurrence of signals from the detector coils with respect to synchronizing signals on lead 154. Also, a specified redundancy in the occurrence of successive signals may be detected so as to preclude the production of a false alarm due to momentary electrical transients. Appropriately processed signals indicative of the actual presence of a marker element in the interrogation zone are then provided to appropriate alarm and passage barrier devices 156 such as depicted in FIG. 1.

In a further embodiment depicted in FIG. 8, a circuit for continuously energizing the field producing coils may comprise a power supply 158 which includes a source of AC power 160 of a desired frequency of oscillation and a bank of resonating capacitors 162.

Having thus described the present invention, what is claimed is:

1. In a system for detecting the passage of objects through an interrogation zone in which means are provided for establishing an alternating magnetic field in the zone and adjacent to which a magnetic field detector is provided for detecting perturbations in the field as may be caused by the presence of a ferromagnetic marker element secured to the objects, the improvement wherein the magnetic field providing means comprises at least a pair of coils, each of which is substantially planar and is positioned on an opposite side of the interrogation zone such that the planes of the coils are parallel to each other and to a corridor defined therebetween, each of the coils being of substantially the same overall dimensions and having a shape similar to one of a "figure-8" or an "hour-glass", each half of each coil consisting of a substantially triangular section symmetric with respect to a horizontal axis passing through the plane of the coil at the crossing or "necked-in" portion thereof, whereby the direction of the magnetic field components in the corridor produced between the coils when connected to an alternating circuit varies significantly in different regions to increase the number of lines of force which will be parallel with a substantially unidimensionally responsive ferromagnetic marker element regardless of its orientation to thereby enhance its detectability in the zone.

2. In a system according to claim 1, the improvement wherein the magnetic field providing means further comprises a power supply for energizing the field producing coils to provide an alternating magnetic field in the interrogation zone, which field oscillates at a frequency of less than 10 KHz.

3. A system according to claim 2, wherein the power supply includes means for energizing the field producing coils to provide a repetitive pulsed magnetic field in the interrogation zone, each pulse of which occurs at an interval ranging between 0.1 and 1.5 seconds and contains oscillations at said frequency within each pulse.

4. A system according to claim 3, wherein the power supply includes means for maintaining each pulse at an interval between 1.0 and 1.2 seconds.

5. In a system according to claim 3, wherein the power supply includes means for energizing the field producing coils to provide a series of damped oscillations within each pulse.

6. In a system according to claim 2, wherein the power supply includes means for continuously energizing the field producing coils.

7. In a system according to claim 2, wherein the power supply includes means for intermittently energizing the field producing coils in response to the presence of a person as may be carrying a said object.

8. In a system according to claim 1, wherein each triangular section comprises a substantially straight horizontal portion and two substantially straight diagonal legs.

9. In a system according to claim 8, wherein the two diagonal legs are positioned at approximately 90° with respect to each other.

10. In a system according to claim 1, the improvement wherein the magnetic field detector comprises at least a pair of substantially planar coils having a shape similar to one of a "figure-8" or "hour-glass" of substantially the same overall dimensions, each of which detector coils is positioned proximate and parallel to one of the field producing coils such that the crossing or "necked-in" portions of each detector and field producing coil are generally aligned.

11. In a system according to claim 10, wherein both of the field producing coils are "figure-8" shaped, and wherein the detector coils are both horizontally disposed "figure-8" shaped coils.

12. In a system according to claim 10, wherein both of the field producing coils are "figure-8" shaped and wherein the detector coils are both "hour-glass" shaped coils, either of which detector coils may be vertically or horizontally disposed.

13. In a system according to claim 10, wherein both the field producing coils are "hour-glass" shaped and wherein both detector coils are "figure-8" shaped, either of which detector coils may be vertically or horizontally disposed.

14. In a system according to claim 10, wherein one of the field producing coils is "figure-8" shaped and one is "hour-glass" shaped and wherein both the detector coils are horizontally disposed "figure-8" coils.

15. In a system according to claim 10, wherein at least one of the detector coils is positioned such that each half thereof extends at 90° with respect to the halves of the proximate field producing coils.

16. In a system according to claim 10, wherein each half of each detector coil consists of a substantially triangular section, having a substantially straight portion and two substantially straight diagonal legs positioned such that the crossing or "necked-in" portion of the detector coils are generally aligned with the crossing portion or the "necked-in" portion of the field producing coils.

17. In a system according to claim 10, wherein the two field producing coils are connected in parallel and wherein the two detector coils are connected in series.

18. In a system for detecting the passage of objects through an interrogation zone in which means are provided for establishing an alternating magnetic field in the zone and adjacent to which a magnetic field detector is provided for detecting perturbations in the field as may be caused by the presence of a ferromagnetic marker element secured to the objects, the improvement wherein the magnetic field providing means comprises at least a pair of coils, each of which is substantially planar and is positioned on an opposite side of the interrogation zone such that the planes of the coils are parallel to each other and to a corridor defined therebetween, each of the coils being of substantially the same overall dimensions and having a shape similar to one of a "figure-8" or an "hour-glass", each half of each coil consisting of a substantially triangular section symmetric with respect to a horizontal axis passing through the plane of the coil at the crossing or "necked-in" portion thereof, whereby the direction of the magnetic field components in the corridor produced between the coils when connected to an alternating current varies significantly in different regions to increase the number of lines of force which will be parallel with a substantially unidimensionally responsibe ferromagnetic marker element regardless of its orientation to thereby enhance its detectability in the zone, and wherein the magnetic field detector comprises at least a pair of substantially planar coils having a shape similar to one of a "figure-8" or "hour-glass" of substantially the same overall dimensions, each of which detector coils is positioned proximate and parallel to one of the field producing coils such that the crossing or "necked-in" portions of each detector and field producing coil are generally aligned.

19. In a system for detecting the passage of objects through an interrogation zone comprising means for producing an alternating magnetic field in the zone, magnetic field detector means positioned adjacent said zone for detecting perturbations in the field, and ferromagnetic marker elements to be secured to objects, the passage of which is to be detected, the presence of which marker elements in the zone produces detectable perturbations in the field, the improvement wherein the magnetic field providing means comprises at least a pair of coils, each of which is substantially planar and is positioned on an opposite side of the interrogation zone such that the planes of the coils are parallel to each other and to a corridor defined therebetween, each of the coils being of substantially the same overall dimensions and having a shape similar to one of a "figure-8" or an "hour-glass", each half of each coil consisting of a substantially triangular section symmetric with respect to a horizontal axis passing through the plane of the coil at the crossing or "necked-in" portion thereof, whereby the direction of the magnetic field components in the corridor produced between the coils when connected to an alternating current varies significantly in different regions to increase the number of lines of force which will be parallel with a substantially unidimensionally responsive ferromagnetic marker element regardless of its orientation to thereby enhance its detectability in the zone.

* * * * *